US009251782B2

(12) United States Patent
Ben Ezra et al.

(10) Patent No.: US 9,251,782 B2
(45) Date of Patent: Feb. 2, 2016

(54) SYSTEM AND METHOD FOR CONCATENATE SPEECH SAMPLES WITHIN AN OPTIMAL CROSSING POINT

(71) Applicant: VivoText Ltd., Misgav (IL)

(72) Inventors: Yossef Ben Ezra, Rehovot (IL); Shai Nissim, Tel-Aviv (IL); Gershon Silbert, Petah-Tikva (IL); Moti Zilberman, Petah-Tikva (IL)

(73) Assignee: VivoText Ltd., Misgav (IL)

( * ) Notice: Subject to any disclaimer, the term of this patent is extended or adjusted under 35 U.S.C. 154(b) by 0 days.

(21) Appl. No.: 14/311,669

(22) Filed: Jun. 23, 2014

(65) Prior Publication Data

US 2014/0303979 A1 Oct. 9, 2014

Related U.S. Application Data

(63) Continuation-in-part of application No. 13/686,140, filed on Nov. 27, 2012, now Pat. No. 8,775,185, which (Continued)

(51) Int. Cl.

| | |
|---|---|
| ***G10L 13/08*** | (2013.01) |
| ***G10L 13/07*** | (2013.01) |
| ***G10L 13/06*** | (2013.01) |

(52) U.S. Cl.

CPC ..... *G10L 13/07* (2013.01); *G10L 13/06* (2013.01)

(58) Field of Classification Search

CPC ..... G10L 13/10; G10L 25/90; G10L 13/07; G10L 25/00; G10L 13/00; G10L 13/08; G10L 2021/105; G10L 19/0208; G10L 21/0232; G10L 15/183; G10L 17/02; G10L 19/20; G10L 13/033; G10L 19/097; G10L 19/167; G10L 2021/01351; G10L 13/06; G10L 13/04; G10L 2021/0135; G10L 13/02; G10L 13/043; G10L 13/027

USPC ..... 704/216–218, 205–207, 258–267

See application file for complete search history.

(56) References Cited

U.S. PATENT DOCUMENTS

| | | | |
|---|---|---|---|
| 4,864,620 | A | 9/1989 | Bialick |
| 5,675,709 | A | 10/1997 | Chiba |

(Continued)

FOREIGN PATENT DOCUMENTS

| | | |
|---|---|---|
| WO | 2008114258 | 9/2008 |

OTHER PUBLICATIONS

E. Moulines and F. Charpentier, "Pitch-Synchronous Waveform Processing Techniques for Text-To-Speech Synthesis using Diphones", Speech Communication, vol. 9, No. 5, pp. 453-467, 1990.

(Continued)

*Primary Examiner* — Huyen Vo

(74) *Attorney, Agent, or Firm* — M&B IP Analysts, LLC

(57) ABSTRACT

A method for identifying an optimal crossing point for concatenation of speech samples within an overlap area is provided. The method includes retrieving a first speech sample and a second speech sample, the second speech sample is concatenated immediately after the first speech sample is concatenated; determining a first region within the ending of the first speech sample and a second region within the beginning of the second speech sample, the first region and the second region are determined respective of relatively high spectral similarity over time between the first speech sample and the second speech sample; identifying an overlap region between the first region and the second region; determining an optimal crossing point between the first speech sample and the second speech sample, the optimal crossing point has a maximum correlation over time; and concatenating the first speech sample and the second speech sample at the optimal crossing point.

17 Claims, 3 Drawing Sheets

Related U.S. Application Data is a continuation of application No. 12/532,170, filed as application No. PCT/IL2008/000385 on Mar. 19, 2008, now Pat. No. 8,340,967.

(60) Provisional application No. 61/894,922, filed on Oct. 24, 2013, provisional application No. 60/907,120, filed on Mar. 21, 2007.

(56) References Cited

U.S. PATENT DOCUMENTS

| | | | | |
|---|---|---|---|---|
| 5,895,449 | A | 4/1999 | Nakajima | |
| 5,915,237 | A | 6/1999 | Boss et al. | |
| 6,006,187 | A | 12/1999 | Tanenblatt | |
| 6,505,158 | B1 | 1/2003 | Conkie | |
| 6,601,030 | B2 | 7/2003 | Syrdal | |
| 6,829,581 | B2 | 12/2004 | Meron | |
| 6,873,955 | B1 | 3/2005 | Suzuki | |
| 7,013,278 | B1 | 3/2006 | Conkie | |
| 7,603,278 | B2 | 10/2009 | Fukada et al. | |
| 8,019,605 | B2 | 9/2011 | Agapi et al. | |
| 8,155,963 | B2 | 4/2012 | Aaron et al. | |
| 8,386,245 | B2 | 2/2013 | Gao | |
| 8,442,833 | B2 | 5/2013 | Chen | |
| 2002/0143526 | A1* | 10/2002 | Coorman et al. | 704/211 |
| 2003/0009336 | A1 | 1/2003 | Kenmochi et al. | |
| 2004/0030555 | A1 | 2/2004 | Van Santen | |
| 2004/0111266 | A1 | 6/2004 | Coorman et al. | |
| 2004/0111271 | A1 | 6/2004 | Tischer | |
| 2004/0148171 | A1 | 7/2004 | Chu et al. | |
| 2006/0069566 | A1 | 3/2006 | Fukada et al. | |
| 2006/0069567 | A1 | 3/2006 | Tischer et al. | |
| 2006/0155544 | A1 | 7/2006 | Chu et al. | |
| 2006/0259303 | A1 | 11/2006 | Bakis | |
| 2006/0265211 | A1 | 11/2006 | Canniff et al. | |
| 2007/0168193 | A1 | 7/2007 | Aaron et al. | |
| 2007/0203704 | A1 | 8/2007 | Ozkaragoz et al. | |
| 2010/0066742 | A1 | 3/2010 | Qian et al. | |
| 2010/0125459 | A1 | 5/2010 | Itoh et al. | |
| 2010/0217584 | A1 | 8/2010 | Hirose et al. | |
| 2010/0241424 | A1 | 9/2010 | Gao | |
| 2013/0035935 | A1 | 2/2013 | Kim et al. | |
| 2013/0144612 | A1 | 6/2013 | Romsdorfer | |
| 2013/0151255 | A1 | 6/2013 | Kim et al. | |
| 2013/0211815 | A1 | 8/2013 | Seligman et al. | |

OTHER PUBLICATIONS

Eide et al. "A Corpus-Based Approach to <AHEM/> Expressive Speech Synthesis", 5th ISCA Speech Synthesis Workshop, Pittsburgh, USA, XP002484987, p. 79-84, Jun. 14, 2004. Abstract, p. 80, r-h col. § 1, 2, p. 81, § [3.Expressive Prosody Models].

Hamza et al. "The IBM Expressive Speech Synthesis System", Interspeech 2004—ICSLP, 8th Conference on Spoken Language Processing, Jeju Island, KR, XP002484988, p. 2577-2580, Oct. 8, 2004. Abstract, p. 2577, § [1. Introduction], p. 2577-2578, § [3.1 Building the Voice Database], Fig.1.

P. Mertens, "Mingus"; accessed at: www.bach.arts.kuleuven.be/pmertenslprosody/mingus.html; 1999-2003, last updated Dec. 29, 2008.

Patent Cooperation Treaty, International Preliminary Report on Patentability, Date of Issuance: Sep. 22, 2009, Re.: Application No. PCT/IL2008/000385.

Patent Cooperation Treaty, International Search Report and Written Opinion of the International Searching Authority, Date of mailing: Jul. 4, 2008, Re.: Application No. PCT/IL2008/000385.

* cited by examiner

SYSTEM AND METHOD FOR CONCATENATE SPEECH SAMPLES WITHIN AN OPTIMAL CROSSING POINT

CROSS-REFERENCE TO RELATED APPLICATIONS

This application claims the benefit of U.S. Provisional Application No. 61/894,922 filed on Oct. 24, 2013. This application is a continuation-in-part (CIP) of U.S. patent application Ser. No. 13/686,140 filed Nov. 27, 2012, now U.S. Pat. No. 8,775,185. The Ser. No. 13/686,140 application is a continuation of U.S. patent application Ser. No. 12/532,170, now U.S. Pat. No. 8,340,967, having a 371 date of Sep. 21, 2009. The Ser. No. 12/532,170 application is a national stage application of PCT/IL2008/00385 filed on Mar. 19, 2008, which claims priority from U.S. Provisional Patent Application No. 60/907,120, filed on Mar. 21, 2007. All of the applications referenced above are herein incorporated by reference.

TECHNICAL FIELD

The present invention relates generally to text-to-speech (TTS) synthesis and, more specifically, to generation of expressive speech from speech samples stored in a TTS library.

BACKGROUND

Text-to-speech (TTS) technology allows computerized systems to communicate with users through synthesized speech. The quality of these systems is typically measured by how natural or human-like the synthesized speech sounds.

Very natural sounding speech can be produced by simply replaying a recording of an entire sentence or paragraph of speech. However, the complexity of human communication through languages and the limitations of computer storage may make it impossible to store every conceivable sentence that may occur in a text. Because of this, the art has adopted a concatenative approach to speech synthesis that can be used to generate speech from any text. This concatenative approach combines stored speech samples representing small speech units such as phonemes, di-phones, tri-phones, or syllables form larger speech signals.

Today, TTS libraries are limited to a certain amount of speech samples from which speech may be generated. These TTS libraries are limited to speech samples that have high spectral similarity in a point where the speech samples may be concatenated together. Typically, spectral similarity is determined based on spectral clustering techniques that are known in the existing art used to cluster similar symbols. Spectral similarity may be determined by using, for example, short-time Fourier transforms (STFT) or, alternatively, Mel-frequency cepstral coefficients (MFCC).

TTS synthesis techniques using the TTS libraries can face a number of difficulties, such as, requiring large amounts of space for speech samples storage needed to produce rich repositories of speech. When such space is not available, a poor speech repository is produced. Moreover, concatenating speech samples is limited to the context in which the speech samples were spoken. For example, in the sentence "Joe went to the store," the speech units associated with the word "store" have a lower pitch than those associated with the question "Joe went to the store?" Because of this, if stored speech samples are simply retrieved without reference to their pitch or duration, some of the speech samples could have the wrong pitch and/or duration for the concatenated speech samples, thereby resulting in unnatural sounding speech.

Existing solutions for producing speech typically require that speech samples be separated from each other and concatenated together in new combinations to enrich the speech repository. However, the drawback of such solutions is that the initial speech sample separation may be inaccurate, therefore production of speech from those speech samples may yield ineffective results. One way to overcome this drawback is by producing speech from a very large set of speech samples. However, maintaining all the speech samples will significantly increases the size of a TSS library, and the time for processing such speech samples.

It would therefore be advantageous to provide an efficient solution for optimally and dynamically concatenating speech samples.

SUMMARY

Certain embodiments disclosed herein include a method and system for identifying an optimal crossing point for concatenation of speech samples within an overlap area. The method comprises retrieving a first speech sample and a second speech sample, wherein the second speech sample is concatenated immediately after the first speech sample is concatenated; determining a first region within the ending of the first speech sample and a second region within the beginning of the second speech sample, wherein the first region and the second region are determined respective of relatively high spectral similarity over time between the first speech sample and the second speech sample; identifying an overlap region between the first region and the second region; determining an optimal crossing point between the first speech sample and the second speech sample based on the identified overlap region, wherein the optimal crossing point has a maximum correlation over time; and concatenating the first speech sample and the second speech sample at the optimal crossing point.

BRIEF DESCRIPTION OF THE DRAWINGS

The subject matter that is regarded disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1:
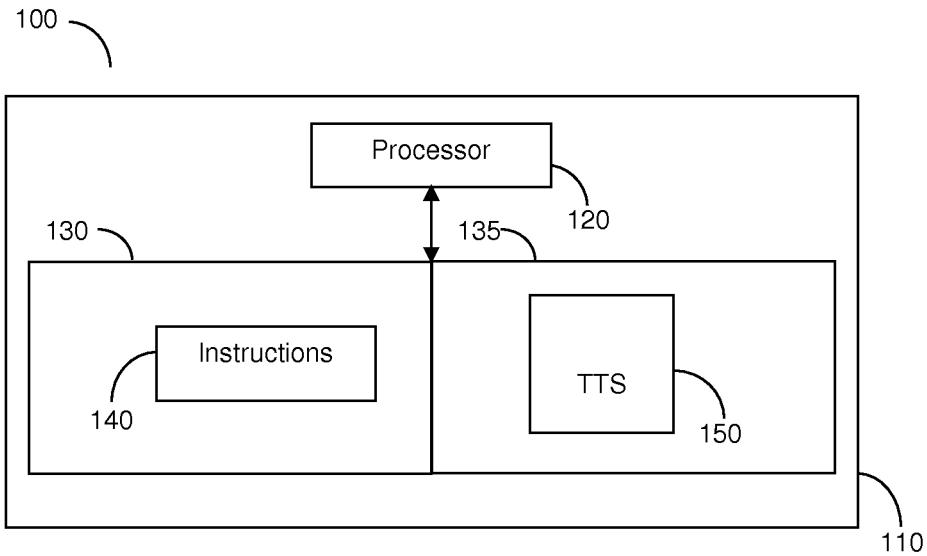
FIG. 1 is a schematic block diagram of a system for identifying an optimal crossing point for concatenation of speech samples according to an embodiment.

It is important to note that the embodiments disclosed herein are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in plural and vice versa with no loss of generality. In the drawings, like numerals refer to like parts through several views.

The various disclosed embodiments include a system and method for analyzing speech samples in order to identify at least one region in at least one speech sample to be optimally concatenated with another speech sample where high correlation is identified. In one exemplary embodiment, the system is configured to retrieve a plurality of speech samples from a text-to-speech (TTS) library. The retrieved samples are then analyzed to determine a region at the beginning and/or end in each one of the speech samples for analysis. The system is further configured to identify overlaps between the speech samples, for example, by analyzing one or more musical parameters (e.g., duration characteristics, pitch features, formants). In an embodiment, signals of the speech samples are analyzed in both the time and frequency domains to identify a maximum correlation between regions of the speech samples. An optimal crossing point between the end of one speech sample and the beginning of another speech sample is determined respective of the analysis, and optionally respective of one or more user's preferences.

FIG. 1 shows an exemplary and non-limiting schematic diagram of a system 100 for identifying an optimal overlap area and an optimal crossing point respective thereto for concatenation of speech samples according to one embodiment. The optimal crossing point is the point where a maximum correlation is identified in the optimal overlap area between two or more speech samples. Identification of optimal crossing points is discussed further herein below with respect to FIG. 4. The system 100 may be a server, which may be any computing device such as, but not limited to, a personal computer (PC), a personal digital assistant (PDA), a mobile phone, a smart phone, a tablet computer, a wearable computing device, and other kinds of wired and mobile appliances, equipped with browsing, viewing, listening, filtering, and managing capabilities, and so.

As illustrated in FIG. 1, the system 100 typically contains a processor 120 and memory unit 130 and 135. The memory unit 130 is an instruction memory that contains instructions 140 for execution by the processor 120. The instructions 140 may carry in part the process for concatenating speech samples based on the embodiments disclosed herein.

The memory unit 135 is configured to contain a text-to-speech (TTS) library 150 of speech samples. The memory unit 135 is also configured to maintain information for TTS conversion. The memory unit 135 may be in a form of a storage device that can be locally connected in the system 100 or communicatively connected to the system 100. The TTS library 150 stored in the memory unit 135 may be updated from an external resource.

Each speech sample may include one or more phonemes. Each phoneme may be pronounced with different musical parameters (e.g., duration characteristics, pitch features, formants) with respect to the origin of each phoneme. In an embodiment, the system 100 is configured to retrieve the speech samples from the TTS library 150 or other source for maintaining information. The server 110 is further configured to determine a region at the beginning and/or end of each speech samples for analyses. TTS libraries, phonemes, and speech samples are discussed further in the above-referenced U.S. Pat. No. 8,340,967, assigned to common assignee, and is hereby incorporated by reference for all that it contains.

The system 100 may use, for example, short-time Fourier transform (STFT) and/or Mel-frequency cepstral coefficients (MFCC), Linear Predictive Coefficients (LPC), Wavelets or Multiwavelets analysis or any other method to determine the region with highest spectral similarity between two speech samples. The system 100 is configured to analyze factors relevant to determining spectral similarity. Such factor include, but are not limited to, musical parameters, energy levels of the pronunciation of the speech samples, the intensity of frequency, and so on. Musical parameters may include pitch characteristics, duration, volume, and so on. Energy levels may be based on the amplitude of waveforms of a given speech sample.

It should be noted that the higher the spectral similarity is over time, a longer the region will be used for the analysis and vice versa. As long as the spectral similarity is low, a shorter region will be analyzed to minimize and/or avoid any inaccuracies in the process.

After the determination of the region is made, the system 100 is configured to perform one or more overlap analyses. In an overlap analysis, a degree of correlation between the two samples is identified at any point via the determined region in the time domain and in the frequency domain. The system 100 is configured to identify, for example, an overlap between the signal of the two speech samples, an overlap between the pitch curves of the two speech samples, and so on.

Upon identifying one or more overlaps, the system 100 is configured to determine an optimal crossing point within the overlaps area respective of, for example, the lowest signal differences, the lowest energy differences, a minimal phase difference (as described in greater detail below with reference to FIG. 4), and so on. According to one embodiment, an optimal overlap area may be determined respective of one or more preferences of a user operating the system 100.

As an example, the user may prefer higher correlation in the time domain than in the pitch behavior. In such an example, the optimal crossing point is determined primarily based on correlation in the time domain. In an embodiment, the overlap analysis is based on correlation of a single considered factor. In another embodiment, correlations of multiple factors from the factors mentioned above may be considered as part of the overlap analysis. In a further embodiment, each correlation may be assigned a weight relative to other correlations, and weighted values for each correlation may be determined and analyzed to yield analysis results. According to one embodiment, the user may provide the analysis' preferences through a graphical user interface (GUI) render by the system 100.

Figure 2:
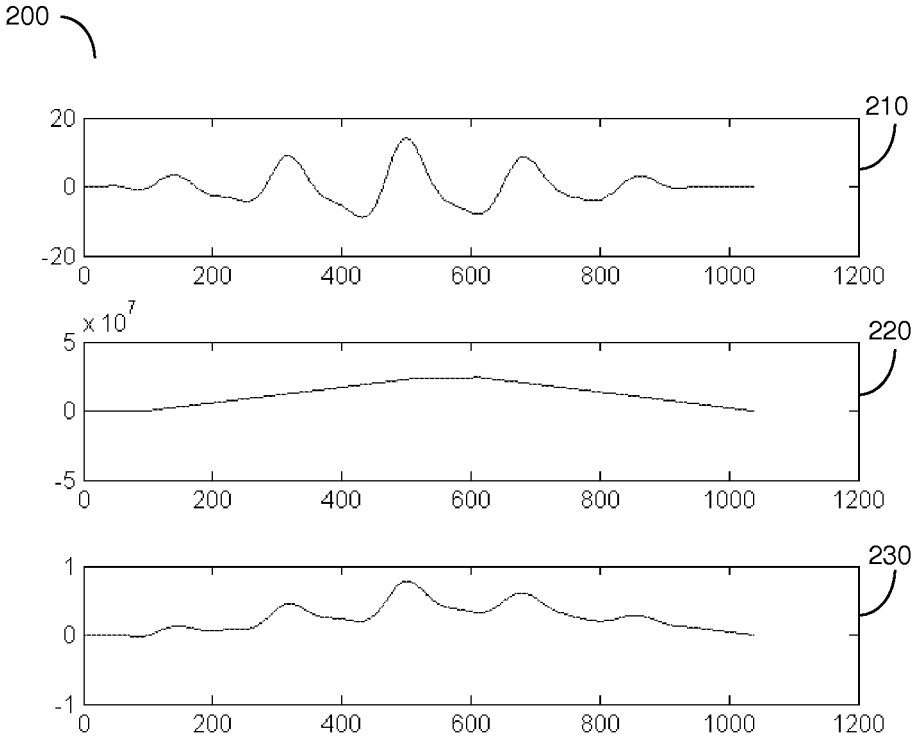
FIG. 2 is series of graphs showing the overlap analysis performed between a first region within the ending of a first speech sample and a second region within the beginning of a second speech sample according to an embodiment.

FIG. 2 shows a series of graphs 200 illustrating an overlap analysis performed between a first region within the ending of a first speech sample and a second region within the beginning of a second speech sample. In an embodiment, the system 100 is configured to identify the degree of correlation between the two speech samples at any point respective of the first region within the first speech sample and the second region within the second speech sample. The system 100, in an embodiment, performs overlaps analysis of the signals of the two speech samples in the time domain 210 to identify a maximum correlation such as, for example, a local maximum correlation in the region between 400 seconds and 600 seconds. Moreover, the system 100 is configured to perform overlaps analysis of the pitch behavior of the two speech samples in the time domain 220.

According to one embodiment, the results of the graph 210 and graph 220 are weighted and normalized to one graph 230 in order to obtain the overlap area respective thereto. It should be noted that, in this embodiment, priority is given to a maximum correlation that is consistent over time. Thus, an overlap area where the maximum correlation occurs over the longest period of time is selected to be further analyzed. An optimal crossing point may be determined respective thereto. The determination of the crossing point is described in greater detail below with reference to FIG. 3.

Figure 3:
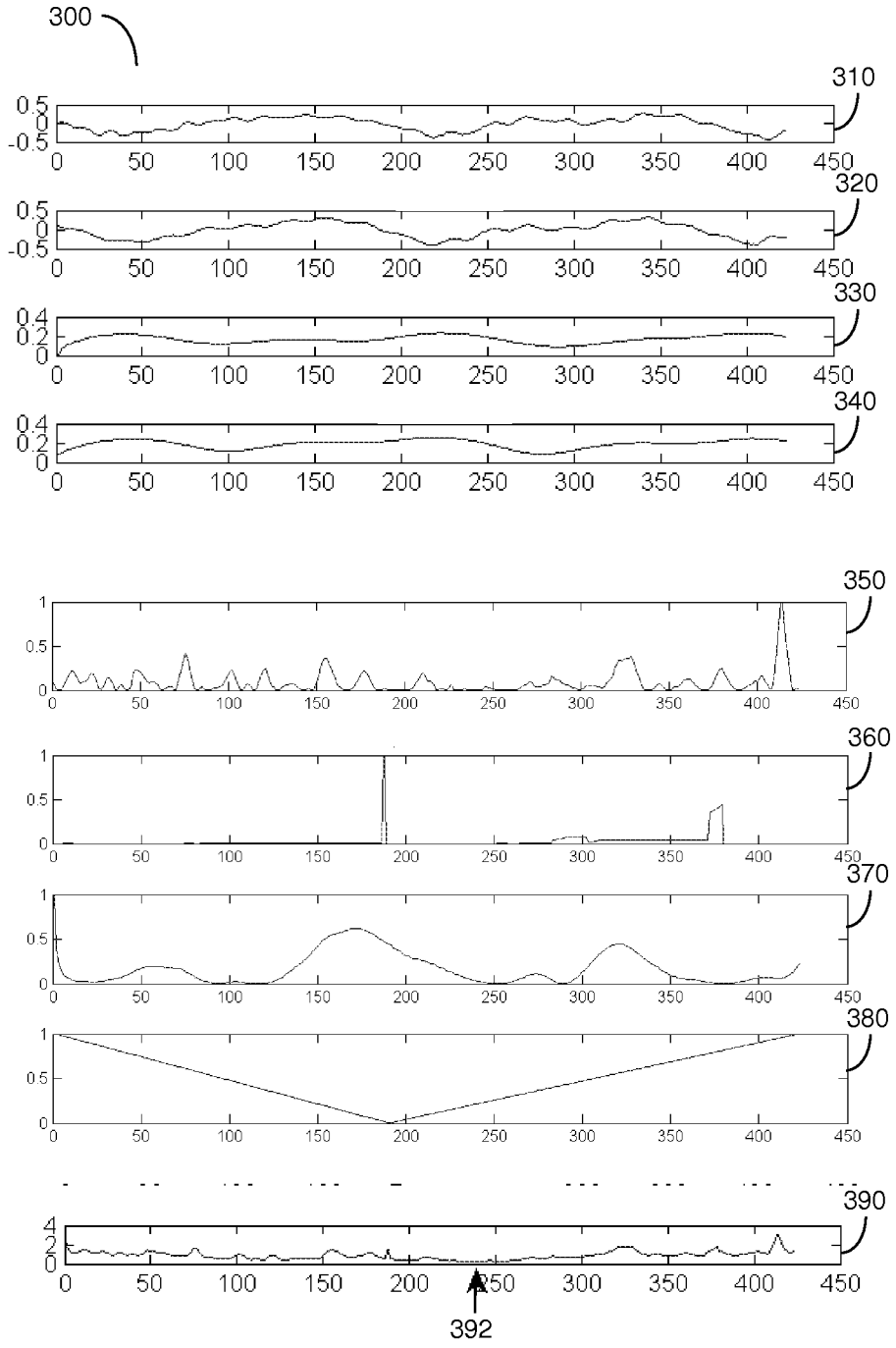
FIG. 3 is a series of graphs used to identify an optimal crossing point between two speech samples according to an embodiment.

FIG. 3 shows a series of graphs 300 used to determine an optimal crossing point for concatenation of two speech samples in an overlap area according to an embodiment. Analyses are performed through the segment of the overlap area where the maximum correlation is identified over the longest time. According to the disclosed embodiments, the signal of the first speech sample is identified in the time domain 310 through the segment with respect to graph 310. The signal of the second speech sample is identified in the time domain 320 through the segment with respect to graph 320. Moreover, the energy level of the two speech samples is identified. In an embodiment, this identification may be performed by a server (e.g., server 110).

The energy of the first speech sample is identified in the time domain (graph 330), and accordingly, the energy of the second speech sample is identified in the time domain (graph 340). It should be noted that the energy level of each speech sample may be different based on the pronunciation of each speech sample and responsive of the nature of one or more phonemes included in each speech sample. As an example, the intensity of the phoneme "ow" in "no trespassing" and in "a notation" is radically different by phonological environment even though the tri-phone environment is similar.

The difference between the signals of the two speech samples is identified along the segment with respect of graph 350. Also, the difference between the energy level of the two speech samples is identified along the segment with respect of graph 370. Furthermore, a phase difference of the two speech samples is identified with respect of graph 360. The phase difference describes the difference in instantaneous states of the signals of the two speech sample. Moreover, the influence of one or more phonemes that were originally placed near the analyzed segment is identified and represented in graph 380.

In various embodiments, a speech unit's neighbors may be considered during analyses. A neighbor is a speech unit that precedes or follows the analyzed speech unit.

One or more phonemes that have similar neighborhood relationships may be given priority over other phonemes with less similar neighborhood relationships. Additionally, when the neighborhood relationships are deemed too dissimilar, they may cease being further considered. Neighborhood relationships represent the pronunciation of a given phoneme in the context of a speech unit's neighbors within the same speech sample.

The result of the analyses described above are typically weighted and/or normalized and presented in graph 390. The graph 390 illustratively shows at least a maximum correlation, or, alternatively, at least a relatively low difference between the two speech samples such as, for example, point 392. According to one embodiment, the optimal crossing point is determined respective of the graph 390. According to another embodiment, the optimal crossing point is determined respective of one or more priorities that may be determined by the server, or, alternatively, respective of one or more user's preferences. The user's preferences may be received directly from the user via, e.g., a user interface. As an example, high level expressivity may be a priority, or, alternatively, high level intelligibility may be a priority.

Figure 4:
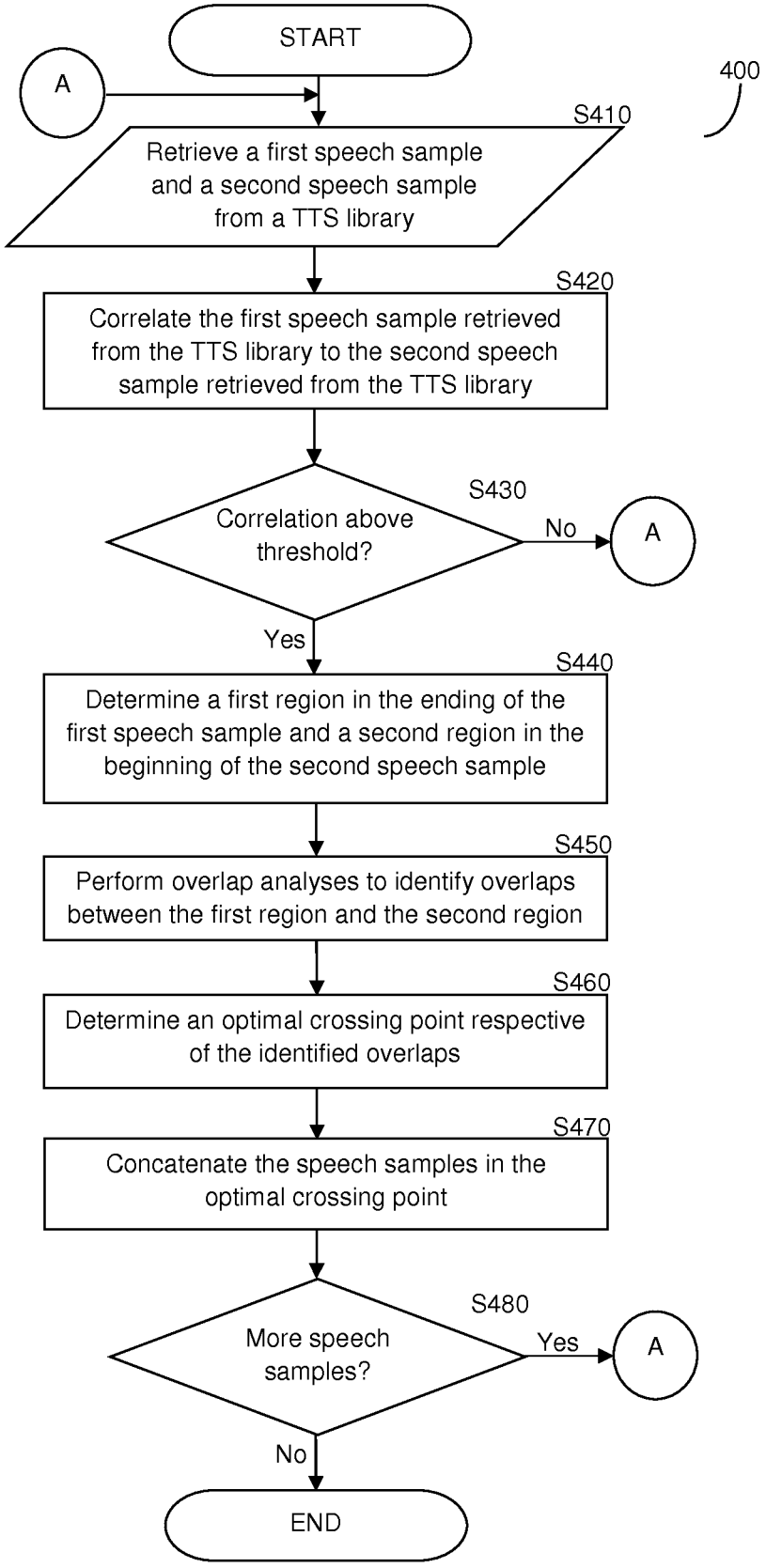
FIG. 4 is a flowchart describing a method for identifying an optimal crossing point within an optimal overlap area of two speech samples according to an embodiment.

FIG. 4 shows an exemplary and non-limiting flowchart 400 describing the method for determining an optimal crossing point for concatenation of two speech samples according to an embodiment. The method may be performed by the server 110.

In S410, a first speech sample and a second speech sample are retrieved. In an embodiment, the speech samples are retrieved from a TTS library (e.g., TTS library 150). In S420, the first speech sample is correlated to the second speech sample. In S430, it is checked whether the correlation between the first speech sample and the second speech sample is above a predefined threshold. If so, execution continues with S440; otherwise, execution proceeds to S410. In S440, a first region within the ending of the first speech sample and a second region within the beginning of the second speech sample that have a potential to be concatenated together are determined. As a non-limiting example in FIG. 2, correlation graphs 210, 220, 230 have peaks at around 500 samples. The temporal region around 500 samples may be suitable to determine the overlap area for concatenation.

In one embodiment, the determination in S440 involves identifying high spectral similarities between the two speech samples. Such identification is made by analyzing, for example, the musical parameters of the two speech samples (e.g., duration characteristics, pitch features, and/or volume), the energy levels of the pronunciation of the two speech samples (e.g., amplitude of sample waveforms), the intensity, the acoustic frequency spectrum, and the like. It should be noted that the higher the spectral similarity is, the longer the determined region will be. Thus, high spectral similarities will yield a priority to preserve more of a potential area for concatenating the speech samples. For example, areas with high quality transitions between the speech sample and its original neighborhood environment may qualify as high spectral similarity and, consequently, would be given higher priority during concatenation. Transitions may be high quality if, e.g., one or more speech units in a speech sample demonstrates high spectral similarity with neighbor speech units respective of neighbor speech units within the same speech sample.

In S450, overlap analyses are performed to determine a degree of correlation between the two speech samples at any point within the determined regions. Such analyses are performed in the time domain and the frequency domain to identify a maximum of correlation. It should be noted that there is a priority do identify an overlap area with relatively high correlation through a longer segment. The signal of the two speech samples, the pitch curves of the two speech samples, and the like are analyzed. The results of the analysis may be weighted and normalized to one graph (e.g., graph 230) to identify at least one relatively high correlation point, or, alternatively, at least one relatively low difference between the two speech samples. A maximum correlation is determined respective of the highest correlation identified and responsive of the longest existing segment. Such longest segment continues to be processed. According to one embodiment, a predefined threshold of a minimum of correlation and/or a maximum of correlation required is determined in the continuation of the process. In an embodiment, when such predefined threshold is not reached, a notification is sent to a user through, e.g., a user interface (not shown) respective thereof.

In S460, the correlatively longest segment identified respective of at least one predetermined priority is analyzed. Priorities indicate which qualities (e.g., musical characteristics, duration, neighbors, and so on) are most desirable. The segment that is determined to have highest priority for a period of time is identified as the correlatively longest segment. In an embodiment, a priority score and/or a time score may be given based on degree of overlapping with the qualities and/or length of the overlapping with such qualities. In a further embodiment, such priority and time scores may be weighted and normalized to one score to yield a correlative length score. In such an embodiment, the segment with the highest correlative length score is identified as the correlatively longest segment.

The priorities may be determined by a server (e.g., server 110), or, alternatively, one or more user's preferences may be received from the user through the user interface. As an example, high level expressivity may be a priority, or, alternatively, high level intelligibility may be a priority. It should be noted that one location in the segment may be prioritized over another. As an example, a priority may be to select an optimal overlap area located in the ending of the first speech sample and/or the beginning of the second speech sample such that the longest segment possible will be further analyzed. As another example, in case the user desires to create high quality expressive speech, this may come at the expense of other features. For example, in such case, higher quantitative score will be given to a longer segment with a variety of musical parameters. This is performed in order to select the most appropriate segments according to user's requirements.

In an exemplary embodiment, S460 may include identifying, for example, the signal differences between the speech samples, the energy differences, the phase differences between the speech samples, and so on. In S470, the speech samples are concatenated in the optimal crossing point. According to one embodiment, information stored in, as a non-limiting example, a TTS library (e.g., TTS library 150), may be used to generate a speech content respective thereof. Such speech content may be stored 150 for further use.

In S480, it is checked whether there are additional speech samples. If so, execution continues with S410; otherwise, execution terminates.

The various embodiments disclosed herein can be implemented as hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such a computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A method for identifying an optimal crossing point for concatenation of speech samples within an overlap area, the method comprising:

retrieving a first speech sample and a second speech sample, wherein the second speech sample is concatenated immediately after the first speech sample is concatenated;

determining a first region within the ending of the first speech sample and a second region within the beginning of the second speech sample, wherein the first region and the second region are determined respective of relatively high spectral similarity over time between the first speech sample and the second speech sample;

identifying an overlap region between the first region and the second region, wherein identifying the overlap region further comprises:

identifying one or more overlaps between a signal of the first speech sample and a signal of the second speech sample; and identifying one or more overlaps between a pitch curve of the first speech sample and a pitch curve of the second speech sample;

determining an optimal crossing point between the first speech sample and the second speech sample based on the identified overlap region, wherein the optimal crossing point has a maximum correlation over time; and concatenating the first speech sample and the second speech sample at the optimal crossing point.

2. The method of claim 1, wherein the first speech sample and the second speech sample are retrieved from a text-to-speech (TTS) library.

3. The method of claim 1, further comprising:

determining a degree of correlation between the first speech sample and the second speech sample at any point through the first region and the second region.

4. The method of claim 3, wherein the degree of correlation is determined in the time domain and in the frequency domain.

5. The method of claim 1, further comprising:

determining at least one of: a signal difference between the first speech sample and the second speech sample, an energy difference between the first speech sample and the second speech sample, a difference in one or more musical parameters between the first speech sample and the second speech sample, and a phase difference between the first speech sample and the second speech sample.

6. The method of claim 5, wherein the one or more musical parameters is at least one of: duration characteristics, pitch features, and formants.

7. The method of claim 5, further comprising:

determining the optimal crossing point between the first speech sample and the second speech sample respective of the differences determined between the first speech sample and the second speech sample based on one or more predefined preferences.

8. The method of claim 1, further comprising:

identifying whether the correlation between the first speech sample and the second speech sample is above a predefined threshold.

9. A non-transitory computer readable medium having stored thereon instructions for causing one or more processing units to execute the method according to claim 1.

10. A system for identifying an optimal crossing point for concatenation of speech samples within an overlap area, the system comprises:

a processor; and a memory coupled to the processor, the memory containing instructions that, when executed by the processor, configure the system to:

retrieve a first speech sample and a second speech sample, wherein the second speech sample is concatenated immediately after the first speech sample is concatenated;

determine a first region within the ending of the first speech sample and a second region within the beginning of the second speech sample, wherein the first region and the second region are determined respective of relatively high spectral similarity over time between the first speech sample and the second speech sample;

identify an overlap region between the first region and the second region;

identify one or more overlaps between a pitch curve of the first speech sample and a pitch curve of the second speech sample in the time domain and in the frequency domain;

determine an optimal crossing point between the first speech sample and the second speech sample based on the identified overlap region, wherein the optimal crossing point has a maximum correlation over time; and concatenate the first speech sample and the second speech sample at the optimal crossing point.

11. The system of claim 10, wherein the first speech sample and the second speech sample are retrieved from a text-to-speech (TTS) library.

12. The system of claim 10, wherein the system is further configured to:

identify one or more overlaps between a signal of the first speech sample and a signal of the second speech sample in the time domain and in the frequency domain.

13. The system of claim 10, wherein the system is further configured to:

determine a degree of correlation between the first speech sample and the second speech sample at any point through the first region and the second region.

14. The system of claim 10, wherein the system is further configured to:

determine at least one of: a signal difference between the first speech sample and the second speech sample, an energy difference between the first speech sample and the second speech sample, a difference in one or more musical parameters between the first speech sample and the second speech sample, and a phase difference between the first speech sample and the second speech sample.

15. The system of claim 14, wherein the one or more musical parameters comprises any of: duration characteristics, pitch features, and formants.

16. The system of claim 14, wherein the system is further configured to:

determine the optimal crossing point between the first speech sample and the second speech sample respective of the differences determined between the first speech sample and the second speech sample and based on one or more predefined preferences.

17. The system of claim 10, wherein the system is further configured to:

identify whether the correlation between the first speech sample and the second speech sample is above a predefined threshold.

* * * * *